US006341620B1

(12) United States Patent
Mutter

(10) Patent No.: US 6,341,620 B1
(45) Date of Patent: Jan. 29, 2002

(54) PRESSURE LIMITING VALVE

(75) Inventor: Heinz Mutter, Winterthur (CH)

(73) Assignee: Greenfield AG, Basel (CH)

( * ) Notice: Subject to any disclaimer, the term of this patent is extended or adjusted under 35 U.S.C. 154(b) by 0 days.

(21) Appl. No.: 09/547,118

(22) Filed: Apr. 11, 2000

(30) Foreign Application Priority Data

Jun. 18, 1999 (EP) ..... 99810545

(51) Int. Cl.[7] ..... G05D 16/02
(52) U.S. Cl. ..... 137/468; 137/505.14
(58) Field of Search ..... 137/468, 505.14

(56) References Cited

U.S. PATENT DOCUMENTS 4,513,881 A * 4/1985 Heimovics, Jr. ..... 222/54
5,174,326 A 12/1992 Steinert et al.
5,423,342 A * 6/1995 Fenner, Jr. ..... 137/14
5,427,132 A 6/1995 Fenner, Jr.

FOREIGN PATENT DOCUMENTS

EP 0 653 585 A1 5/1995

* cited by examiner

*Primary Examiner*—Stephen M. Hepperle
(74) *Attorney, Agent, or Firm*—Townsend and Townsend and Crew LLP

(57) ABSTRACT

A pressure limiting valve includes an inlet and an outlet for a fluid, which includes a valve body which cooperates with a valve seat in such a manner that it opens or closes a flow connection for the fluid between the inlet and the outlet when a limiting pressure is reached. The valve also includes a spring element which acts on the valve body and loads the latter. A container for a liquid is provided which is arranged and designed in such a manner that through its thermal expansion, the liquid varies the loading of the valve body which is caused by the spring element, and thus varies the limiting pressure in dependence on the temperature of the liquid.

10 Claims, 4 Drawing Sheets

PRESSURE LIMITING VALVE

BACKGROUND OF THE INVENTION

1. Field of the Invention

The invention relates to a pressure limiting valve.

2. Description of the Prior Art

Pressure limiting valves are required for example in gas filling stations in which mobile pressure containers, such as e.g. the supply container of a gas-operated motor vehicle, are filled with gas. Gas filling stations of this kind typically comprise a stationary storage container which is filled with compressed gas and a discharge device in order to connect this storage container to the mobile supply container, so that the gas can flow from the storage container into the mobile supply container.

Compressed natural gas above all is increasingly gaining in importance as an alternative fuel for motor vehicles. In order to enable a satisfactory range of motor vehicles which are operated with natural gas and at the same time to keep the dimensions of the supply container in the motor vehicle within reasonable limits, these supply containers are typically filled up to pressures of approximately 200 bar with respect to a reference temperature of 15° C. For this, filling methods and stations have been developed which enable a very simple and rapid filling of motor vehicles of this kind—in comparison with the filling with gasoline. A method of this kind and a gas filling station of this kind respectively are described in detail in EP-A-653 585.

A problem in gas filling stations consists in that the ambient temperature which is present during the filling must be taken into account for the final pressure up to which the mobile supply container is to be filled. If it is namely assumed that this final pressure should amount to approximately 200 bar at a reference temperature of 15° C., then it is clear that at an outer temperature of less than 15° C. the final pressure at which the filling is terminated must amount to less than 200 bar in order to ensure that no impermissibly high pressure arises in the mobile supply container in the event that the ambient temperature rises. Conversely, the filling can be carried out up to a final pressure of more than 200 bar by an ambient temperature of more than 15° C. without the danger that a too high pressure in the supply container arises.

In fact, it is possible to measure the fluctuations of the ambient temperature via temperature sensors and then to realize the correct, temperature corrected final pressure for the filling by means of suitable control devices, but methods of this kind are however relatively complex and expensive. It is therefore desirable to have a pressure limiting valve available which takes temperature fluctuations of this kind into account without assistance.

SUMMARY OF THE INVENTION

The object of the invention is thus to provide as simple a pressure limiting valve as possible which automatically varies the limiting pressure at which it opens or closes respectively in dependence on temperature.

In accordance with the present invention a pressure limiting valve is proposed which comprises an inlet and an outlet for a fluid, which comprises a valve body which cooperates with a valve seat in such a manner that it opens or closes a flow connection for the fluid between the inlet and the outlet when a limiting pressure is reached, and which comprises a spring element which acts on the valve body and loads the latter, with a container for a liquid furthermore being provided which is arranged and designed in such a manner that the liquid varies through its thermal expansion the loading of the valve body which is caused by the spring element and thus varies the limiting pressure in dependence on the temperature of the liquid.

The volume of the liquid in the container varies as a result of its thermal expansion. If for example the temperature of the liquid rises, then its volume increases. Through this increase in volume the spring element is compressed, whereby the loading of the valve body which is caused by the spring element rises. Thus the limiting pressure also rises at which the pressure limiting valve closes or opens respectively. Conversely, the volume of the liquid decreases when the temperature decreases. Thereby, the spring element is somewhat relaxed and the loading of the valve body decreases. As a result the limiting pressure at which the valve closes or opens drops. Thus the pressure limiting valve automatically varies its limiting pressure in dependence on the temperature, whereby a temperature dependent pressure limitation is enabled in a simple manner.

The container for the liquid is preferably designed as a hollow cylinder and comprises a movable pressure piston, which is braced at the one side on the spring element and which is charged at the other side by the pressure of the liquid.

In a first preferred embodiment the inner wall of the hollow cylinder guides the pressure piston, which means that the inner diameter of the hollow cylinder is substantially the same as the diameter of the pressure piston. The movable pressure piston forms a boundary surface of the volume which is available to the liquid in the interior of the hollow cylinder.

In a second preferred, particularly compact embodiment an inner cylinder is provided which is arranged coaxially in the hollow cylinder, with the pressure piston being provided in the inner cylinder and being guided by the latter, and with the inner cylinder having an opening so that the liquid can act on the pressure piston.

The cross-sectional area of the pressure piston is preferably larger than the effective cross-sectional area of the valve body which is charged by the pressure of the fluid. This measure namely has the advantage that the pressure of the liquid in the container can be chosen significantly less than the limiting pressure at which the valve closes or opens respectively.

In accordance with a further development of the pressure limiting valve in accordance with the invention, means are provided for a thermal contact between the fluid and the liquid so that the liquid in the container has substantially the same temperature as the fluid. For this for example a pressure line can be provided in the container which is surrounded by the liquid and through which the fluid flows. In accordance with the principle of the heat exchanger the liquid then assumes the same temperature as the fluid. As a result the liquid varies the limiting pressure of the pressure limiting valve in dependence on the current temperature of the fluid.

The container preferably comprises setting means in order to vary the volume which is available to the liquid. These setting means serve for the adjusting or the calibrating respectively of the pressure limiting valve. The setting means comprise for example an adjusting piston which is matched to the inner diameter of the hollow cylindrical container and the position of which can be varied via a setting screw. By rotating the setting screw the adjusting piston can be displaced along the longitudinal axis of the hollow cylinder, whereby the volume which is available to the liquid can be varied. For adjusting the pressure limiting valve the position of the adjusting piston and thus the tension of the spring element is varied at a known reference temperature until the limiting pressure belonging to this reference temperature is reached.

In order to achieve a sufficiently large temperature dependence of the limiting pressure of the pressure limiting valve, the container preferably contains a liquid in the operating state, the thermal coefficient of volume expansion of which amounts to at least $10^{-4}$ $K^{-1}$, in particular to at least $5 \cdot 10^{-4}$ $K^{-1}$. It is particularly preferred to use oil, which typically has coefficients of volume expansion of this magnitude, as the liquid.

In particular in regard to gas filling stations, especially for natural gas, in which the pressure limiting valve serves to close the pressure line when the temperature dependent filling pressure has been reached, the limiting pressure is preferably linearly dependent on the temperature of the liquid, with the slope amounting in particular to from 1.5 bar/K to 2 bar/K, because this slope corresponds to the pressure-temperature relationship of natural gas. The slope of the limiting pressure as a function of the temperature can be set to the desired value in a simple manner by the amount of liquid in the container in the pressure limiting valve in accordance with the invention.

In gas filling stations for natural gas the pressure limiting valve is preferably set in such a manner that the limiting pressure amounts to from 180 bar to 220 bar when the liquid in the container has reached a temperature of 15° C.

BRIEF DESCRIPTION OF THE DRAWINGS

The invention will be described in the following with reference to exemplary embodiments and with reference to the drawings. Shown in the schematic drawings, in which the same reference symbols designate parts which are identical or have an equivalent function, are.

DETAILED DESCRIPTION OF SPECIFIC EXEMPLARY EMBODIMENTS

Figure 1:
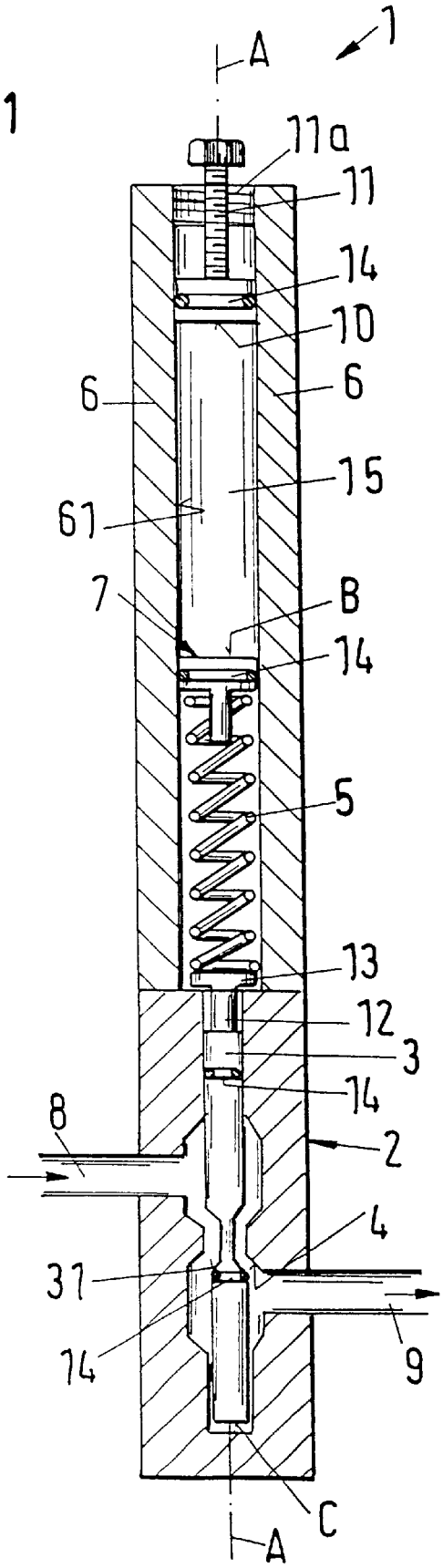
FIG. 1 is a longitudinal section through a first exemplary embodiment of the pressure limiting valve in accordance with the invention.

FIG. 1 shows in a schematic longitudinal sectional illustration a first exemplary embodiment of a pressure limiting valve in accordance with the invention, which is designated in its entirety by the reference number 1. The pressure limiting valve 1 comprises a valve housing 2 with an inlet 8 and an outlet 9 for a fluid. A spring-loaded valve body 3 with a sealing surface 31 is provided in the valve housing 2 and cooperates in known manner with the valve seat 4 such that it closes or opens respectively the flow connection for the fluid between the inlet 8 and the outlet 9 when a limiting pressure is reached. FIG. 1 shows the pressure limiting valve 1 in its open position.

Furthermore, a spring element 5, for example a helical spring, is provided which acts on the valve body 3 and loads the latter with a spring force. For this the spring element 5 is braced at a tappet head 13 at which a tappet 12 adjoins which presses against the end surface of the valve body 3. The upper part of the valve body 3 in the illustration, which adjoins at said end surface, is guided in a longitudinal bore of the valve housing 2 and is sealed off with an O-ring 14.

As FIG. 1 shows, the valve body 3 is loaded by the spring element 5 in such a manner that a force, which is illustrated to be directed downwardly, acts on the valve body 3 and attempts to push the latter out of the valve seat 4. On the other hand, the fluid, which flows from the inlet 8 to the outlet 9 in the open position of the pressure limiting valve 1, exerts a pressure on the valve body 3 which effects a force on the valve body 3 which is illustrated to be directed upwardly and which counteracts the force which is caused by the spring loading. As long as the force caused by the spring loading is larger than that caused by the fluid, the pressure limiting valve 1 remains in its open position. When the pressure of the fluid at the outlet 9 has risen to such an extent that the force on the valve body 3 resulting from it is larger than that which is caused by the spring loading, the valve body 3 will be pressed upwards in accordance with the illustration so that its sealing surface 31 is pressed sealingly into the valve seat 4. Then the pressure limiting valve 1 is located in its closure position and the flow connection for the fluid between the inlet 8 and the outlet 9 is closed. This pressure, at which the pressure limiting valve 1 changes from its open position to its closed position, is designated as the limiting pressure. For assisting the sealing function between the valve seat 4 and the sealing surface 31, which, in this case, is designed to be conical, an O-ring 14 can be provided.

At the valve housing 2 there adjoins a container for a liquid, which is designed as a hollow cylinder 6 with a longitudinal axis A. The hollow cylinder 6 is manufactured of a pressure resistant material, typically of steel. The end of the hollow cylinder 6 which is illustrated below is firmly connected to the valve housing 2, for example by screwing. The spring element 5 is arranged in the interior of the hollow cylinder 6 and extends in the direction of the longitudinal axis A. A pressure piston 7 which is movable in the direction of the longitudinal axis A and which is dimensioned in such a manner that it is guided by the inner wall 61 of the hollow cylinder 6 is braced at the end of the spring element 5 which faces away from the valve body 3. An O-ring 14 is provided between the pressure piston 7 and the inner wall 61 for sealing.

The inner space of the hollow cylinder 6 is bounded at its upper end in the illustration by an adjusting piston 10, the diameter of which corresponds substantially to the inner diameter of the hollow cylinder 6. The adjusting piston 10 is provided with an O-ring 14 which serves as a piston ring for sealing. The adjusting piston 10 is connected to a setting screw 11 which is guided in a threaded piece 1*a* and the head of which protrudes out of the hollow cylinder 6. Through rotating the setting screw 11 the adjusting piston 10 can be displaced in the direction of the longitudinal axis A. After the pressure limiting valve 1 has been adjusted or set respectively in a manner which will be described further below, the adjusting piston 10 remains during normal operation in a position which is fixed by the setting screw 11.

The end surface of the adjusting piston 10 at the one end, the end surface of the pressure piston 7 at the other end, and the inner wall 61 of the hollow cylinder 6 bound a liquid-tight volume 15 of the interior of the hollow cylinder 6. This volume 15 is completely filled with a liquid, preferably an oil. The hollow cylinder is sealed off by the O-rings 14 at the adjusting piston 10 and at the pressure piston 7, respectively, so that substantially no oil can escape from the volume 15.

In order to put the pressure limiting valve 1 into operation, the oil which fills the volume 15 is first placed under pressure by means of the setting screw 11 and the adjusting piston 10. The setting of the pressure will be explained further below. The pressure of the oil charges the pressure piston 7, which thereby compresses the spring element 5. By means of the tension of the spring element 5 the valve body 3 is loaded via the tappet head 13 and the tappet 12. Thus the pressure limiting valve 1 is held in its open position until the pressure which is exerted on the valve body 3 on the other side by the fluid reaches the limiting pressure. When the limiting pressure is exceeded, the pressure limiting valve 1 closes.

The limiting pressure of the pressure limiting valve 1 thus depends on the loading which the spring element 5 exerts on the valve body 3. If now the ambient temperature changes during operation, then the temperature of the oil in the hollow cylinder 6 also changes, because the oil is in thermal contact with the surroundings via the wall of the hollow cylinder 6. If for example the temperature of the oil increases, then the oil expands and thereby displaces the pressure piston 7 downwards in the illustration.

Hereby, the spring element 5 is more strongly compressed, through which the loading of the valve body 3 which is caused by the spring element 5 increases. As a result the limiting pressure increases, which means that the pressure limiting valve 1 closes only at a higher pressure. Conversely, a lowering of the ambient temperature has the result that the oil also cools and in so doing reduces its volume. Thereby, the pressure piston moves upwards in the illustration, from which a partial relaxing of the spring element 5 and thus a reduction of the loading of the valve body 3 results, which is effected by the spring element 5. As a result, the limiting pressure of the pressure limiting valve 1 is lowered, which means that it already closes at a lower pressure of the fluid.

The pressure limiting valve in accordance with the invention thus has the property that it automatically changes the limiting pressure during temperature fluctuations.

As can be seen in FIG. 1 the cross-sectional area B of the pressure piston 7 is preferably larger than the effective cross-sectional area C of the valve body 3 which is charged by the pressure of the fluid. Hereby, namely a kind of hydraulic transmission can be ensured. Since the pressure of the liquid charges a cross-sectional area B which is larger than the effective cross-sectional area C which is loaded by the pressure of the fluid, only a significantly lower pressure is required on the liquid side, i.e. at the pressure piston 7, than on the fluid side in order to compensate the force which is exerted by the fluid on the valve body 3. A lesser pressure in the hollow cylinder 6 is on the one hand advantageous for reasons of operating safety and of the constructional cost and complexity, and on the other hand facilitates the sealing off of the volume 15.

The spring element 5 is preferably designed in such a manner that it is relatively soft, which means that the spring element 5 has a lower spring constant. Through this measure, namely the closing interval or the opening interval respectively, more particularly, the time which the pressure limiting valve 1 requires in order to arrive from the open position to the closing position (or vice versa respectively), can be shortened. If the spring element 5 is for example a helical spring then a low spring constant can be realized in that the helical spring is designed to be as long as possible.

In the following the adjusting and the operation of the pressure limiting valve 1 will be now described with reference to a concrete example of an application. In this, reference will be made to the case that the pressure limiting valve 1 is part of a gas filling station by means of which a mobile pressure container, such as e.g. the supply container of a gas-operated motor vehicle, is filled with compressed natural gas up to a final pressure. In this case the fluid is natural gas. The pressure limiting valve 1 is provided in a discharge device by means of which the compressed natural gas is filled from a stationary storage container into the mobile supply container. The pressure of the natural gas in the storage container typically amounts to approximately 200 bar with respect to a reference temperature of 15° C. The inlet 8 of the pressure limiting valve 1 is connected to a pressure line which is connected at the other end to the stationary storage container. The outlet 9 is connected via a further pressure line to the mobile supply container. The task of the pressure limiting valve 1 is to close the flow connection between the inlet 8 and the outlet 9 as soon as the pressure in the mobile supply container—and thus the pressure at the outlet 9—reaches the final pressure for the filling, so that no further natural gas can then flow into the mobile supply container. This final pressure is dependent on the ambient temperature. It amounts for example to 200 bar at 15° C. A typical co value which describes the pressure-temperature relationship of natural gas—at least in the temperature interval of approximately −40° C. to +50° C. which is relevant in practice—is a pressure increase of 1.6 bar at a temperature increase of 1 K.

In the pressure limiting valve 1 in accordance with the invention two factors mainly influence the dependence of the limiting pressure on the temperature, namely on the one hand the relative thermal volume expansion coefficient $\beta$ of the liquid in the container (in FIG. 1 the container is the hollow cylinder 6), or stated more precisely, the difference between the thermal expansion of the liquid and the thermal expansion of the material of which the container is manufactured, and on the other hand the amount of liquid which is contained in the container.

In practice it has proved advantageous if the thermal volume expansion coefficient $\beta$ of the liquid amounts to at least $10^{-4}$ $K^{-1}$, in particular to at least $5 \cdot 10^{-4}$ $K^{-1}$. In the described embodiment the liquid is an oil which has a volume expansion coefficient of $7 \cdot 10^{-4}$ $K^{-1}$. The use of oil as the liquid has the additional advantages that the oil lubricates the O-ring 14 at the pressure piston 7 and that lower frictional losses arise in comparison with other liquids. In addition, practically no hysteresis in the limiting pressure-temperature curve arises even in the event of multiple temperature increases and decreases.

The hollow cylinder 6 is manufactured of steel, which typically has a relatively linear thermal expansion $\alpha \approx 11 \cdot 10^{-6}$ $K^{-1}$, which means that the relative volume expansion of the steel is more than one order of magnitude less than that of the oil.

Figure 2:
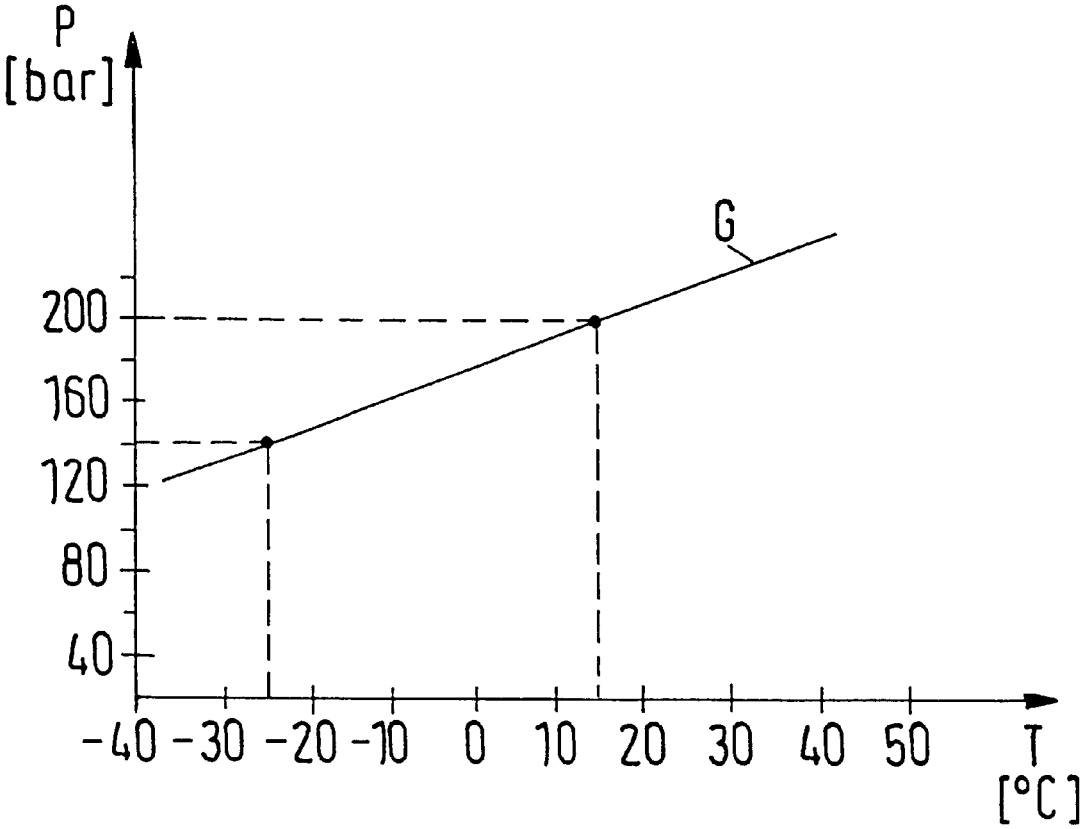
FIG. 2 is a diagram illustrating the dependence of the limiting pressure on the temperature.

The diagram of FIG. 2 shows the dependence of the limiting pressure of the pressure limiting valve 1 on the temperature of the oil. On the vertical axis p the limiting pressure is plotted in bar, on the horizontal axis T the temperature in ° Celsius. In FIG. 2 the substantially linear dependence of the limiting pressure on the temperature can be clearly recognized (straight line G). In regard to the use for compressed natural gas the amount of oil in the volume 15 of the hollow cylinder is dimensioned in such a manner that the slope of the straight line G amounts to 1.6 bar/K. It is however evident that other slopes of the straight line G can be realized for other uses, for example by changing the amount of oil in the hollow cylinder 6.

For adjusting or setting respectively the pressure limiting valve 1 one proceeds as follows: After the amount of oil which has been determined on the basis of the desired slope of the limiting pressure-temperature curve has been filled into the hollow cylinder 6, the latter is closed off with the adjusting piston 10 or with the threaded piece 1 la respectively. Now, the adjusting piston 10 is displaced in the direction towards the pressure piston 7 by rotating the setting screw 11 at a reference temperature of for example 15° C. Thereby, the tension of the spring element 5 increases and thereby the load exerted on the valve body 3. As a result the limiting pressure increases. The adjusting piston 10 is moved by rotating the setting screw 11 until the desired limiting pressure—here 200 bar—is reached at the reference temperature. The pressure limiting valve 1 is then ready for operation.

During the setting of the adjusting piston 10 the straight line G in FIG. 2 is thus subjected to a parallel displacement until it passes through the desired working point (here 200 bar at 15° C.).

During operation the pressure limiting valve 1 now automatically regulates the limiting pressure in dependence on the temperature. If for example a motor vehicle is filled with compressed natural gas at an ambient temperature of −25° C., then the pressure limiting valve 1 closes at a limiting pressure of 140 bar (see FIG. 2), which means that the pressure limiting valve 1 terminates the filling process at a final pressure of 140 bar in the supply container of the motor vehicle. If the ambient temperature increases, e.g. to 15° C., then first the hollow cylinder 6 and then the oil located in it assumes this temperature, whereby the limiting pressure is increased to 200 bar, as described above. As a result, at an ambient temperature of 15° C. the pressure limiting valve 1 only terminates the filling process at 200 bar. The pressure limiting valve 1 thereby enables an automatic adaptation of the final pressure of the filling to the temperature.

Figure 3:
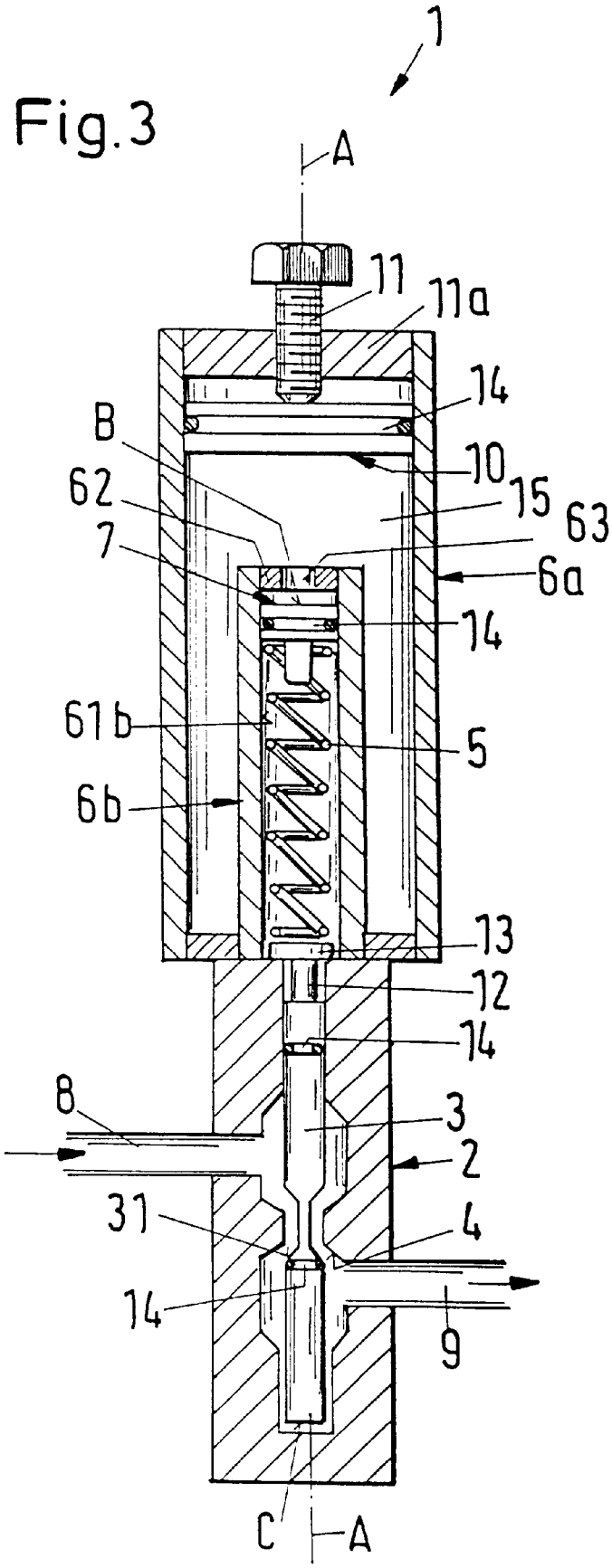
FIG. 3 is a longitudinal section through a second exemplary embodiment of the invention.

FIG. 3 shows a longitudinal section through a second exemplary embodiment of the pressure limiting valve in accordance with the invention. In the following only the differences from the first exemplary embodiment will be explained. Otherwise the explanations in connection with the first exemplary embodiment apply in analogous manner to the second exemplary embodiment as well.

In the second exemplary embodiment the container for the liquid is designed in the shape of a double cylinder. An inner cylinder 6*b* is coaxially arranged in an outer hollow cylinder 6*a*. The pressure piston 7 and the spring element 5 are provided in the inner cylinder 6*b*, with the diameter of the pressure piston 7 being dimensioned in such a manner that the pressure piston 7 is guided by the inner wall 61*b* of the inner cylinder 6*b*. In the end side 62 of the inner cylinder 6*b* facing away from the valve body 3 an opening 63 is provided through which the liquid which is located in the outer hollow cylinder 6*a* can penetrate into the inner cylinder 6*b* so that the liquid can act on the pressure piston 7. This second exemplary embodiment with its double cylindrical construction is distinguished in particular by its compact and space-saving design.

Figure 4:
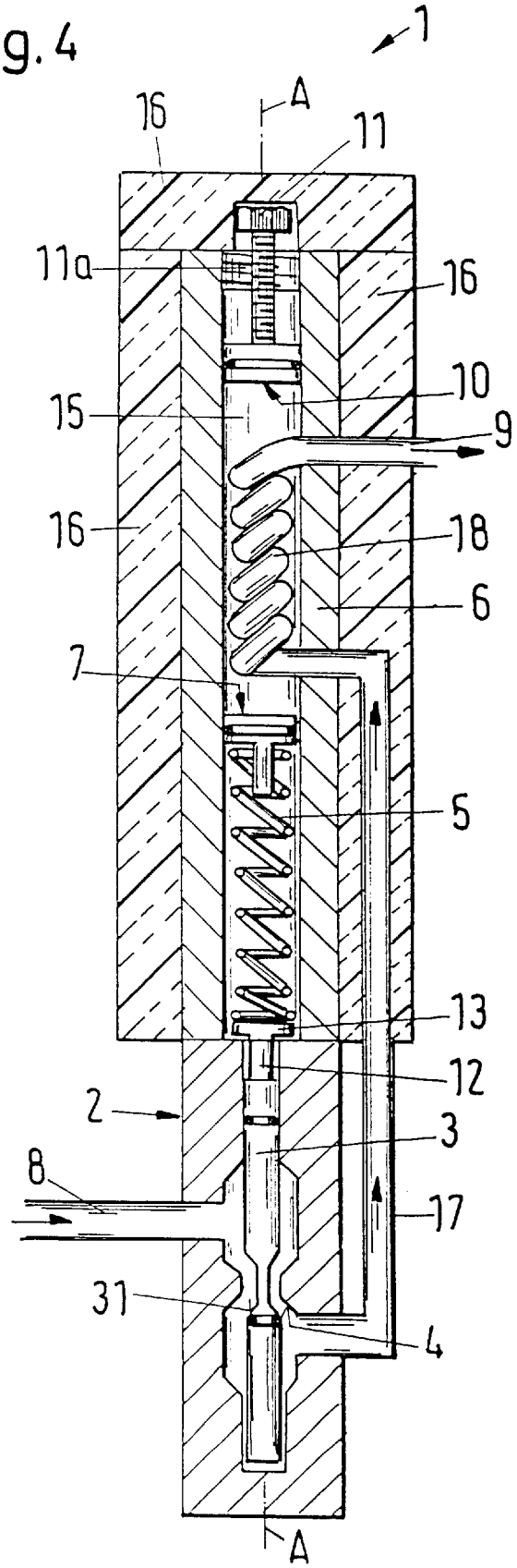
FIG. 4 is a longitudinal section through a third exemplary embodiment of the invention.

FIG. 4 shows in a longitudinally sectioned illustration a third exemplary embodiment of the pressure limiting valve 1 in accordance with the invention provided with a further development which can be realized both in combination with the first and, in an analogous manner, in combination with the second exemplary embodiment.

The further development consists in that means are provided for a thermal contact between the fluid and the liquid which is located in the container 6; 6*a* so that the liquid in the container 6; 6*a* has substantially the same temperature as the fluid.

In the third exemplary embodiment a pressure line 17 leads from the region of the inner space of the valve housing 2 lying downstream into the interior of the hollow cylinder 6 in which the liquid is located. In the inner space of the hollow cylinder 6 the pressure line 17 is designed as a helix 18, which represents a heat exchanger for the fluid and the liquid. The pressure line 17 extends from the end of the helix 18 through the wall of the hollow cylinder 6 to the outlet 9 of the pressure limiting valve 1. The hollow cylinder 6 is surrounded by an insulation 16 in order to prevent or to reduce the heat exchange respectively between the surroundings and the hollow cylinder 6. This further development is also suitable in particular for uses in which the ambient temperature of the hollow cylinder 6 is not representative for the current temperature of the fluid.

The fluid flows through the inlet 8 to the pressure line 17 and through the helix 18 when the pressure limiting valve 1 is open. In this the fluid comes into thermal contact with the liquid in the hollow cylinder 6, whereby a temperature compensation between these two media takes place, which means that the liquid substantially assumes the temperature of the fluid. As a result the pressure limiting valve 1 varies its limiting pressure in dependence on the current temperature of the fluid.

Naturally, embodiments of the further development are also possible in which the fluid first comes into thermal contact with the liquid in the hollow cylinder 6 and then arrives at the inlet 8.

It is self-evident that the pressure limiting valve 1 in accordance with the invention is also suitable for uses other than those in connection with gas filling stations. The pressure limiting valve 1 can also be used as a safety or excess pressure valve in other pressure systems. Furthermore, the fluid which flows through the pressure limiting valve 1 can be another gas or a vapor or a liquid.

Through the possibility of varying the slope of the limiting pressure-temperature curve (see FIG. 2) in a simple manner, namely for example via the amount of liquid in the container 6; 6*a*, the pressure limiting valve in accordance with the invention can be adapted for numerous uses without a great cost and complexity.

The setting means for the volume available to the liquid, which comprise for example the adjusting piston 10 and the setting screw 11 as explained above, bring about the advantage that the "zero point" or the working point through which the limiting pressure-temperature curve (FIG. 2) is to pass can also be varied in a very simple manner.

It is also possible to design the pressure limiting valve 1 in such a manner that it opens when the limiting pressure is exceeded, thus passes from its closing position into its opening position and thereby for example opens an excess pressure flow-off.

Furthermore, embodiments are possible in which the spring element 5 biases the valve seat 4 against the valve body 3, which means that the spring element 5 exerts a force on the valve body which presses the latter with its sealing surface into the valve seat as long as the counter-pressure through the fluid does not exceed the limiting pressure.

What is claimed is:

1. A pressure limiting valve comprising an inlet and an outlet for a fluid, a valve body, a valve seat which cooperates with the valve body in such a manner that the valve body opens or closes a flow connection for the fluid between the inlet and the outlet when a limiting pressure is reached, and a spring element that acts on the valve body and loads the valve body, wherein a container for a liquid is provided that is arranged and designed in such a manner that through thermal expansion of the liquid, the liquid varies the loading of the valve body that is caused by the spring element and thus varies the limiting pressure in dependence on the temperature of the liquid, wherein the container for the liquid is designed as a hollow cylinder and comprises a movable pressure piston that is braced at the one side on the spring element and that is charged at the other side by the pressure of the liquid, and wherein the pressure limiting valve further comprises an inner cylinder that is arranged coaxially in the hollow cylinder, wherein the pressure piston is provided in the inner cylinder and is guided by the inner cylinder, and wherein the inner cylinder has an opening so that the liquid may act on the pressure piston.

2. A pressure limiting valve in accordance with claim 1, wherein the cross-sectional area of the pressure piston is larger than the effective cross-sectional area of the valve body that is charged by the pressure of the fluid.

3. A pressure limiting valve in accordance with claim 1, wherein means are provided for a thermal contact between the fluid and the liquid so that the liquid in the container has substantially the same temperature as the fluid.

4. A pressure limiting valve in accordance with claim 1, wherein the container comprises setting means in order to vary the volume that is available for the liquid.

5. A pressure limiting valve in accordance with claim 1, wherein the container contains a liquid in the operating state, the thermal coefficient of volume expansion of which amounts to at least $10^{-4}$ $K^{-1}$.

6. A pressure limiting valve in accordance with claim 1, wherein the limiting pressure is substantially linearly dependent on the temperature of the liquid.

7. A pressure limiting valve in accordance with claim 1, wherein the limiting pressure amounts to from 180 bar to 220 bar when the liquid in the container has a temperature of 15° C.

8. A pressure limiting valve in accordance with claim 5 wherein the thermal coefficient of volume expansion is at least $5 \cdot 10^{-4}$ $K^{-1}$.

9. A pressure limiting value in accordance with claim 6 wherein the limiting pressure has a slope in a range of 1.5 bar/K to 2 bar/K.

10. A gas filling station comprising a pressure limiting valve, wherein the pressure limiting valve comprises an inlet and an outlet for a fluid, a valve body, a valve seat which cooperates with the valve body in such a manner that the valve body opens or closes a flow connection for the fluid between the inlet and the outlet when a limiting pressure is reached, and a spring element that acts on the valve body and loads the valve body, wherein a container for a liquid is provided that is arranged and designed in such a manner that through thermal expansion of the liquid, the liquid varies the loading of the valve body that is caused by the spring element and thus varies the limiting pressure in dependence on the temperature of the liquid, wherein the container for the liquid is designed as a hollow cylinder and comprises a movable pressure piston that is braced at the one side on the spring element and that is charged at the other side by the pressure of the liquid, and wherein the pressure limiting valve further comprises an inner cylinder that is arranged coaxially in the hollow cylinder, wherein the pressure piston is provided in the inner cylinder and is guided by the inner cylinder, and wherein the inner cylinder has an opening so that the liquid may act on the pressure piston.

* * * * *